US006767506B2

(12) United States Patent
Bronfin et al.

(10) Patent No.: US 6,767,506 B2
(45) Date of Patent: Jul. 27, 2004

(54) HIGH TEMPERATURE RESISTANT MAGNESIUM ALLOYS

(75) Inventors: Boris Bronfin, Buer Shevn (IL); Eliyahu Aghion, Omer (IL); Frank Von Buch, Lelferde (DE); Soenke Schumann, Schwnelper (DE); Horst Friedrich, Wolfenbuttel (DE); Mark Katzir, Beer Shave (IL)

(73) Assignees: Dead Sea Magnesium Ltd., Beer-Sheva (IL); Volkswagen AG, Woltsburg (DE)

( * ) Notice: Subject to any disclaimer, the term of this patent is extended or adjusted under 35 U.S.C. 154(b) by 97 days.

(21) Appl. No.: 10/098,950

(22) Filed: Mar. 14, 2002

(65) Prior Publication Data

US 2003/0129074 A1 Jul. 10, 2003

(30) Foreign Application Priority Data

Jan. 10, 2002 (IL) ..... 147561

(51) Int. Cl.[7] ..... C22C 23/04
(52) U.S. Cl. ..... 420/411
(58) Field of Search ..... 420/405, 406, 420/411

(56) References Cited

U.S. PATENT DOCUMENTS 3,419,385 A 12/1968 Foerster et al.
3,687,135 A * 8/1972 Stroganov et al. ..... 128/92 B
4,116,731 A 9/1978 Tikhova et al.
4,149,882 A * 4/1979 Unsworth et al. ..... 75/168 J
4,194,908 A 3/1980 Unsworth et al.
4,401,621 A 8/1983 Unsworth et al.
4,997,622 A * 3/1991 Regazzoni et al. ..... 420/407
6,139,651 A * 10/2000 Bronfin et al. ..... 148/420
6,193,817 B1 * 2/2001 King et al. ..... 148/20

FOREIGN PATENT DOCUMENTS

GB 1 463 609 2/1977

OTHER PUBLICATIONS

Communication from the European Patent Office EPO Form 1507.0 with attached 2–page European Search Report, in English.

* cited by examiner

*Primary Examiner*—Daniel Jenkins
(74) *Attorney, Agent, or Firm*—Anderson Kill + Olick, P.C.; Eugene Lieberstein; Michael N. Meller

(57) ABSTRACT

A magnesium-based alloy containing at least 92 wt % magnesium, 2.7 to 3.3 wt % neodymium, 0.0 to 2.6 wt % yttrium, 0.2 to 0.8 wt % zirconium, 0.2 to 0.8 wt % zinc, 0.03 to 0.25 wt % calcium, and 0.00 to 0.001 wt % beryllium. The alloy may additionally contain up to 0.007 wt % iron, up to 0.002 wt % nickel, up to 0.003 wt % copper, and up to 0.01 wt % silicon, and incidental impurities. The alloy may contain from 0.2 to 0.5 wt % Zn, and from 0.03 to 0.15 wt % Ca, and 2.9–3.2 wt % Nd, 1.9–2.1 wt % Y, 0.3–0.5 wt % Zr, 0.2–0.4 wt % Zn, and 0.03–0.12 wt % Ca.

28 Claims, 7 Drawing Sheets

Table 1. Chemical compositions of alloys

| Alloy | Nd % | Y % | Zr % | Zn % | Ca % | Be % | Si % | Fe % | Cu % | Ni % |
|---|---|---|---|---|---|---|---|---|---|---|
| Example 1 | 2.8 | - | 0.48 | 0.32 | 0.05 | 0.0005 | 0.007 | 0.004 | 0.001 | 0.001 |
| Example 2 | 3.0 | 0.15 | 0.44 | 0.25 | 0.10 | - | 0.005 | 0.005 | 0.001 | 0.001 |
| Example 3 | 2.9 | 0.25 | 0.55 | 0.34 | 0.07 | - | 0.006 | 0.004 | 0.001 | 0.001 |
| Example 4 | 2.9 | 0.5 | 0.42 | 0.37 | 0.06 | - | 0.003 | 0.003 | 0.001 | 0.001 |
| Example 5 | 3.1 | 1.0 | 0.33 | 0.41 | 0.04 | 0.003 | 0.008 | 0.004 | 0.001 | 0.001 |
| Example 6 | 3.2 | 1.6 | 0.29 | 0.35 | 0.04 | - | 0.006 | 0.004 | 0.001 | 0.001 |
| Example 7 | 2.9 | 2.1 | 0.48 | 0.23 | 0.03 | - | 0.008 | 0.005 | 0.001 | 0.001 |
| Example 8 | 3.1 | 2.4 | 0.45 | 0.29 | 0.17 | - | 0.005 | 0.04 | 0.001 | 0.001 |
| Example 9 | 3.0 | 2.3 | 0.24 | 0.42 | 0.04 | 0.0004 | 0.006 | 0.006 | 0.001 | 0.001 |
| Example 10 | 3.2 | 1.9 | 0.35 | 0.36 | 0.12 | 0.0003 | 0.006 | 0.005 | 0.001 | 0.001 |
| Comparative Example 1 | 2.6* | 4.1 | 0.45 | - | - | - | 0.0008 | 0.008 | 0.002 | 0.001 |
| Comparative Example 2 | 1.5** | - | 0.45 | 4.1 | - | - | 0.0008 | 0.014 | 0.002 | 0.001 |
| Comparative Example 3 | 2.1 | 2.4 wt% silver | 0.42 | - | - | - | 0.009 | 0.017 | 0.007 | 0.002 |
| Comparative Example 4 | 2.2 | 2.3 | 0.45 | 0.1 | 0.04 | - | 0.006 | 0.005 | 0.007 | 0.001 |
| Comparative Example 5 | 2.3 | 3.6 | 0.35 | 0.8 | 0.03 | - | 0.007 | 0.004 | 0.006 | 0.001 |

* The mixture of 2.2 wt% Nd and 0.4 wt% heavy rare earth metals (0.15 wt% Gd + 0.10 wt% Dy + 0.08 wt% Er + 0.07 wt% Yt)
** Cerium based mishmetall

Table 1. Chemical compositions of alloys

| Alloy | Nd % | Y % | Zr % | Zn % | Ca % | Be % | Si % | Fe % | Cu % | Ni % |
|---|---|---|---|---|---|---|---|---|---|---|
| Example 1 | 2.8 | - | 0.48 | 0.32 | 0.05 | 0.0005 | 0.007 | 0.004 | 0.001 | 0.001 |
| Example 2 | 3.0 | 0.15 | 0.44 | 0.25 | 0.10 | - | 0.005 | 0.005 | 0.001 | 0.001 |
| Example 3 | 2.9 | 0.25 | 0.55 | 0.34 | 0.07 | - | 0.006 | 0.004 | 0.001 | 0.001 |
| Example 4 | 2.9 | 0.5 | 0.42 | 0.37 | 0.06 | - | 0.003 | 0.003 | 0.001 | 0.001 |
| Example 5 | 3.1 | 1.0 | 0.33 | 0.41 | 0.04 | 0.003 | 0.008 | 0.004 | 0.001 | 0.001 |
| Example 6 | 3.2 | 1.6 | 0.29 | 0.35 | 0.04 | - | 0.006 | 0.004 | 0.001 | 0.001 |
| Example 7 | 2.9 | 2.1 | 0.48 | 0.23 | 0.03 | - | 0.008 | 0.005 | 0.001 | 0.001 |
| Example 8 | 3.1 | 2.4 | 0.45 | 0.29 | 0.17 | - | 0.005 | 0.04 | 0.001 | 0.001 |
| Example 9 | 3.0 | 2.3 | 0.24 | 0.42 | 0.04 | 0.0004 | 0.006 | 0.006 | 0.001 | 0.001 |
| Example 10 | 3.2 | 1.9 | 0.35 | 0.36 | 0.12 | 0.0003 | 0.006 | 0.005 | 0.001 | 0.001 |
| Comparative Example 1 | 2.6* | 4.1 | 0.45 | - | - | - | 0.0008 | 0.008 | 0.002 | 0.001 |
| Comparative Example 2 | 1.5** | - | 0.45 | 4.1 | - | - | 0.0008 | 0.014 | 0.002 | 0.001 |
| Comparative Example 3 | 2.1 | 2.4 wt% silver | 0.42 | - | - | - | 0.009 | 0.017 | 0.007 | 0.002 |
| Comparative Example 4 | 2.2 | 2.3 | 0.45 | 0.1 | 0.04 | - | 0.006 | 0.005 | 0.007 | 0.001 |
| Comparative Example 5 | 2.3 | 3.6 | 0.35 | 0.8 | 0.03 | - | 0.007 | 0.004 | 0.006 | 0.001 |

* The mixture of 2.2 wt% Nd and 0.4 wt% heavy rare earth metals (0.15 wt% Gd + 0.10 wt% Dy + 0.08 wt% Er + 0.07 wt% Yt)

** Cerium based mishmetall

Fig. 3

Table 2. Castability properties

| Alloy | Spiral Length [mm] | Ring Width [mm] | Melt Loss [mm] |
|---|---|---|---|
| Example 1 | 200 | 12.5 | 2.1 |
| Example 2 | 210 | 12.5 | 2.0 |
| Example 3 | 205 | 12.5 | 1.9 |
| Example 4 | 215 | 12.5 | 2.0 |
| Example 5 | 220 | 15 | 1.8 |
| Example 6 | 225 | 12.5 | 1.8 |
| Example 7 | 225 | 12.5 | 1.9 |
| Example 8 | 220 | 15 | 1.9 |
| Example 9 | 215 | 15 | 2.1 |
| Example 10 | 225 | 12.5 | 1.9 |
| Comparative Example 1 | 185 | 20 | 3.9 |
| Comparative Example 2 | 195 | 30 | 4.9 |
| Comparative Example 3 | 165 | 25 | 4.2 |
| Comparative Example 4 | 200 | 17.5 | 3.0 |
| Comparative Example 5 | 190 | 20 | 3.5 |

Fig. 4

Table 3. Mechanical properties of new alloys

| Alloy | TYS [MPa] | | UTS [MPa] | E [%] | Fatigue Strength [MPa] | MCR · $10^9$ [$s^{-1}$] | | Stress [MPa] to produce 0.2% creep strain | | CR [$mg/cm^2/day$] |
|---|---|---|---|---|---|---|---|---|---|---|
| | 20°C | 250°C | | | | 200°C 150 MPa | 250°C 60 MPa | 200°C | 250°C | |
| Example 1 | 155 | 130 | 260 | 8 | 100 | 6.2 | 2.9 | 110 | 40 | 0.43 |
| Example 2 | 157 | 135 | 258 | 7 | 105 | 6.0 | 2.8 | 112 | 40 | 0.45 |
| Example 3 | 158 | 135 | 262 | 6 | 108 | 5.4 | 2.4 | 120 | 42 | 0.51 |
| Example 4 | 162 | 137 | 261 | 7 | 110 | 4.1 | 2.4 | 135 | 57 | 0.37 |
| Example 5 | 167 | 137 | 262 | 6 | 115 | 3.1 | 2.2 | 145 | 62 | 0.41 |
| Example 6 | 175 | 145 | 264 | 7 | 118 | 2.9 | 2.0 | 150 | 68 | 0.44 |
| Example 7 | 190 | 160 | 265 | 7 | 120 | 2.4 | 1.9 | 162 | 75 | 0.38 |
| Example 8 | 192 | 159 | 260 | 6 | 119 | 2.5 | 1.8 | 160 | 73 | 0.34 |
| Example 9 | 194 | 163 | 264 | 6 | 122 | 2.6 | 1.9 | 165 | 77 | 0.29 |
| Example 10 | 195 | 162 | 263 | 6 | 121 | 2.5 | 2.0 | 167 | 77 | 0.37 |
| Comparative Example 1 | 185 | 150 | 250 | 5 | 105 | 2.6 | 2.3 | 160 | 60 | 0.57 |
| Comparative Example 2 | 140 | 55 | 205 | 4 | 90 | 1518 | 2124 | 50 | 20 | 5.9 |
| Comparative Example 3 | 188 | 115 | 255 | 3 | 100 | 545 | 385 | 83 | 31 | 7.7 |
| Comparative Example 4 | 135 | 120 | 245 | 6 | 92 | 7.9 | 2.5 | 110 | 58 | 0.59 |
| Comparative Example 5 | 150 | 135 | 250 | 4 | 112 | 3.1 | 2.1 | 120 | 67 | 0.64 |

Fig. 5

Table 4. Chemical compositions of alloys

| Alloy | Nd % | Y % | Zr % | Zn % | Ca % | Be % | Si % | Fe % | Cu % | Ni % |
|---|---|---|---|---|---|---|---|---|---|---|
| Example 11 | 2.9 | 0.2 | 0.45 | 0.37 | 0.03 | 0.002 | 0.004 | 0.003 | 0.001 | 0.001 |
| Example 12 | 2.8 | 0.55 | 0.42 | 0.51 | - | - | 0.005 | 0.004 | 0.001 | 0.001 |
| Example 13 | 2.9 | 1.2 | 0.38 | 0.22 | 0.05 | - | 0.004 | 0.004 | 0.001 | 0.001 |
| Example 14 | 3.0 | 1.8 | 0.41 | 0.28 | 0.02 | 0.003 | 0.006 | 0.004 | 0.001 | 0.001 |
| Example 15 | 3.2 | 2.0 | 0.28 | 0.42 | 0.03 | - | 0.006 | 0.004 | 0.001 | 0.001 |
| Comparative Example 6 | - | - | 0.58 | 5.3 | - | - | 0.009 | 0.009 | 0.003 | 0.001 |
| Comparative Example 7 | 2.2 | 1.9 | 0.47 | 0.29 | - | - | 0.007 | 0.006 | 0.001 | 0.001 |
| Comparative Example 8 | 2.5 | 3.7 | 0.41 | - | - | - | 0.006 | 0.005 | 0.001 | 0.001 |

Fig. 6

Table 5. Mechanical properties of new alloys

| Alloy | TYS [MPa] | UTS [MPa] | E [%] | CYS [MPa] | Impact strength [ J ] | Fatigue strength [MPa] | |
|---|---|---|---|---|---|---|---|
| | | | | | | air | 5% NaCl solution |
| Example 11 | 180 | 270 | 19 | 185 | 65 | 110 | 66 |
| Example 12 | 190 | 280 | 18 | 192 | 63 | 112 | 70 |
| Example 13 | 210 | 285 | 17 | 215 | 62 | 114 | 72 |
| Example 14 | 220 | 290 | 17 | 225 | 60 | 116 | 74 |
| Example 15 | 225 | 294 | 15 | 228 | 58 | 120 | 76 |
| Comparative Example 6 | 240 | 330 | 16 | 190 | 45 | 108 | 26 |
| Comparative Example 7 | 155 | 250 | 12 | 160 | 52 | 95 | 52 |
| Comparative Example 8 | 178 | 265 | 12 | 180 | 50 | 107 | 59 |

Fig. 7

HIGH TEMPERATURE RESISTANT MAGNESIUM ALLOYS

FIELD OF THE INVENTION

The present invention relates to magnesium-based alloys suitable for applications at temperatures as high as 250–300° C., which alloys have good mechanical properties, corrosion resistance, and castability.

BACKGROUND OF THE INVENTION

Magnesium alloys, being the lightest structural metal material, are very attractive in automotive and aerospace industries. New alloys are required that would resist the increasingly onerous operating environment, and that would provide more complex components with increased lifetime and reduced maintenance costs.

An ideal alloy should meet several conditions related to its behavior both during its casting and during its use under continued stress. The good castability includes good flow of melted alloy into thin mold sections, low sticking of the melted alloy to the mold, and resistance to oxidation during the casting process. The alloy should not develop cracks during cooling and solidifying stage of casting. The parts that are cast of the alloy should have high tensile and compressive yield strength, and during their usage they should show a low continued strain under stress at elevated temperatures (creep resistance). The alloy should be further resistant to the corrosion. Some applications, for example use as parts of the gear-box or a crankcase, require that the resistance to corrosion and to mechanical stress be also kept at high temperatures.

The physical and chemical properties of the alloy depend substantially on the presence of other metallic elements, which can form a variety of intermetallic compounds, conferring on the alloy improved mechanical and chemical properties. The selection of elements and their ratio in the alloy is important also from the economic viewpoint, since the cost of the alloy represents a significant part of the total component cost.

Magnesium alloys can conveniently be categorized into two groups, namely Mg—Al based alloys and Mg—Zr based alloys. The best known representative of Mg—Al group is alloy AZ91E which is widely used due to its good castability and good corrosion resistance. However, this alloy has decreased strength and creep resistance above 120° C. In addition, the outcropping microporosity followed by lack of pressure tightness is often present in castings, and the mechanical properties of said alloy can vary with section thickness. The mentioned drawbacks, characteristic for Mg—Al alloys, are overcome in Mg—Zr alloys. Zirconium exhibits a potent grain refining effect on magnesium, leading to the greater casting integrity, and improved mechanical properties. Mg—Zr alloys have more consistent properties through thin and thick sections, and are not prone to outcropping through-wall porosity, which prevents lubricant leakage. A variety of alloys, exploiting the unique effect of zirconium, have been developed, some being based on the mixture Mg—Zr—Zn—RE (rare earth elements), wherein RE is usually a rare earth mixture with cerium as the major component, others being based on the mixture Mg—Zr—Nd—Ag. Commercial magnesium alloys of the former group, like ZE41 and EZ33, provide moderate strength at ambient temperature with retention of properties up to 150° C. Alloys of the latter group, like QE22, can be solution heat-treated and artificially aged to give high strength at temperatures both ambient and higher than 150° C. However, both mentioned groups of alloys exhibit poor corrosion resistance due to the presence of 2–5% Zn or 1.5–2.5% Ag. In addition, silver is an expensive element.

Trying to improve existing alloys, yttrium was introduced as a major alloying element. It was found that the presence of yttrium considerably improved the high-temperature properties of the alloys. British patent No. 1,463,609 describes magnesium-based alloy containing 2.5 to 7 wt % yttrium, 1.25 to 3 wt % silver, 0.5 to 3 wt % rare earth metals, 0 to 1 wt % zirconium, 0 to 0.5 wt % zinc, and optionally other components. U.S. Pat. No. 4,194,908 discloses magnesium-based alloys containing 0.1 to 2.5 wt % yttrium, 1.6 to 3.5 wt % silver, 0.1 to 2.3 wt % rare earth metals of which at least 60% is neodymium, and optionally other elements. The patent demonstrates that an improved creep resistance at elevated temperatures could be obtained by the addition of smaller quantities of yttrium to magnesium alloys containing silver and neodymium. When the yttrium content is less than 0.5 wt %, thorium should be present too. However, thorium is radioactive, and its use in magnesium alloys is prohibited. U.S. Pat. No. 3,419,385 discloses magnesium-based alloy which comprises 0.2 to 10 wt % yttrium, 0.5 to 2 wt % silver, 0.1 to 6 wt % zinc, and possibly manganese and zirconium. The alloys of this invention are mostly designated for extrusions. In sand casting, the alloys of this invention are inferior than conventional alloys like QE22. The American patent U.S. Pat. No. 4,116,731 discloses magnesium-based alloys, exhibiting high temperature stability, which are heat treated and aged and which do without silver, said alloys containing 0.8 to 6.0 wt % yttrium, 0.5 to 4 wt % neodymium, 0.1 to 2.2 wt % zinc, 0.31 to 1.1 wt % zirconium, up to 0.05 wt % copper and up to 0.2 wt % manganese, provided that no less than 50% of the total amount of neodymium and yttrium additions enters the solid solution after heat treatment. U.S. Pat. No. 4,401,621 discloses magnesium-based alloys which comprise 1.5 to 10% of yttrium component of which at least 60% is yttrium and the balance are heavy RE metals, 1 to 6 wt % of neodymium component of which at least 60% is neodymium, and possibly other elements, including up to 1% silver. The alloys of said patent exhibit better creep properties than any conventional magnesium alloys including QE22, EZ33, ZE41 and ZC63 alloys, and in addition they have a good corrosion resistance. However, the high content of yttrium makes the alloys too expensive. Moreover, these alloys exhibit worse castability, particularly fluidity, since yttrium increases viscosity of the molten magnesium.

It is therefore an object of this invention to provide magnesium alloys suitable for long-term applications up to 250° C. and short-term applications up to 300° C. which have good castability.

It is an object of this invention to provide magnesium-based alloys suitable for use sand casting, permanent mold casting, and direct chill casting with subsequent extrusion or/and forging.

It is also an object of this invention to provide alloys, which are well adapted for plastic forming operations such as forging and extrusion.

It is another object of the present invention to provide alloys, which exhibit excellent combination of strength, creep resistance and corrosion resistance.

It is a further object of this invention to provide alloys, which exhibit low corrosion fatigue.

It is still a further object of this invention to provide alloys, which exhibit the aforesaid behavior and properties, and have a relatively low cost, particularly in comparison with commercial magnesium alloys of the types of WE43 or WE54.

Other objects and advantages of the present invention will appear as the description proceeds.

SUMMARY OF THE INVENTION

The present invention relates to magnesium-based alloys suitable for applications at temperatures as high as 250–300° C. which have good mechanical properties, corrosion resistance, and castability. Said alloys contain at least 92 wt % magnesium, and 2.7 to 3.3 wt % neodymium, 0.0 to 2.6 wt % yttrium, 0.2 to 0.8 wt % zirconium, 0.2 to 0.8 wt % zinc, 0.03 to 0.25 wt % calcium, and 0.00 to 0.001 wt % beryllium. The contents of iron, nickel, copper, and silicon are not higher than 0.007 wt %, 0.002 wt %, 0.003 wt %, and 0.01 wt % respectively. A preferred ratio between yttrium and neodymium contents is from 0.45 to 0.70, and a preferred zirconium content is calculated according to the following equation:

$$1.3/(wt\ \%\ \mathrm{Nd}+wt\ \%\ \mathrm{Y})\leqq wt\ \%\ \mathrm{Zr}\leqq 0.6\ wt\ \%$$

The alloys of this invention are well adopted for sand casting, permanent mold casting, and direct chill casting with subsequent extrusion or/and forging.

The invention further relates to articles produced by casting and forming magnesium-based alloys having the properties defined hereinbefore.

BRIEF DESCRIPTION OF THE DRAWINGS

The above and other characteristics and advantages of the invention will be more readily apparent through the following examples, and with reference to the appended drawings, wherein:

FIG. 3 is Table 1, showing chemical compositions of alloys of Examples 1–10 and Comparative Examples 1–5;

FIG. 4 is Table 2, showing castability properties of the alloys of Examples 1–10 and Comparative Examples 1–5;

FIG. 5 is Table 3, showing mechanical properties of the alloys of Examples 1–10 and Comparative Examples 1–5;

FIG. 6 is Table 4, showing chemical compositions of alloys of Examples 11–15 and Comparative Examples 6–8; and FIG. 7 is Table 5, showing mechanical properties of the alloys of Examples 11–15 and Comparative Examples 6–8.

DETAILED DESCRIPTION OF THE INVENTION

Figure 1:
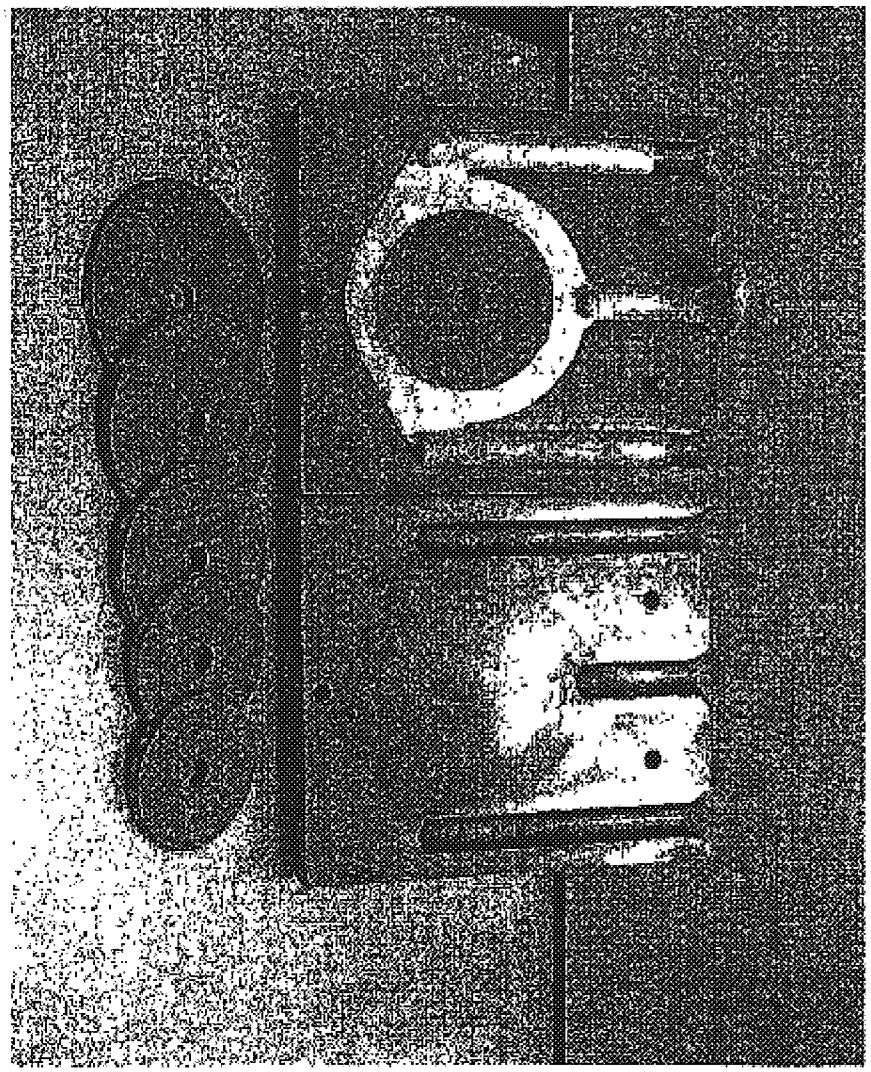
FIG. 1 is a photograph demonstrating the ring test.

It has now been found that certain combinations of elements in magnesium-based alloys, comprising neodymium, yttrium, zirconium, zinc, and calcium confer on the alloys superior properties. These properties include good castability, excellent creep and corrosion resistance combined with high tensile and compressive yield strength at ambient and elevated temperatures 200° C. and 250° C.

A magnesium-based alloy of the present invention contains 2.7 to 3.3 wt % neodymium. If the Nd content is less than 2.7 wt %, the alloy will not have sufficient strength at ambient temperatures. On the other hand, Nd content higher than 3.3 wt % will lead to embrittlement of the alloy due to excess of intermetallic compounds. An alloy of the present invention contains yttrium up to 2.6 wt %. Yttrium has a good solubility in Mg-based solid solution, which decreases with decreasing temperature and consequently permits an age hardening response. The presence of yttrium and neodymium in the alloy leads to marked precipitation hardening after T6 treatment, which includes solid solution treatment, quenching and aging. The yttrium content higher than 2.6 wt % can cause embrittlement, not mentioning the increased cost, since yttrium is an expensive element. The alloy of this invention also contains zirconium as a unique grain refiner of magnesium. Zr also benefits corrosion resistance of the alloy and prevents porosity in castings. It has been found that 0.2 wt % of zirconium is sufficient for grain refining. The upper limit for the zirconium content is 0.8 wt % due to its limited solubility in liquid magnesium. The alloy of this invention contains from 0.2 to 0.8 wt % zinc which imparts to it improved castability, particularly fluidity. At higher Zn contents, the most of Y and Nd will be bound as a stable Zn—Y—Nd eutectic intermetallic compound, insoluble in solid magnesium, thus suppressing the alloy's response to aging. The zinc content is preferably lower than 0.5 wt %. The alloys of this invention further contain calcium from 0.03 wt % to 0.25 wt %, as an oxidation inhibitor, optionally accompanied by up to 0.001 wt % of beryllium. The calcium content is preferably lower than 0.15 wt %, thus preventing possible porosity problems. The beryllium content is preferably lower than 0.0005 wt % in order to prevent grain coarsening.

Silicon is a typical magnesium impurity that is used for the preparation of alloys, however, its content should not exceed 0.01 wt %, and preferably it should be lower than 0.007 wt %. Iron, copper and nickel lower the corrosion resistance of magnesium alloys. Therefore, the alloys of this invention do not contain more than 0.007 wt % iron, 0.003 wt % copper, and 0.002 wt % nickel, and preferably they contain less than 0.005 wt % Fe, 0.0015 wt % Cu, and 0.001 wt % Ni.

In a preferred embodiment, the articles are produced by sand casting, permanent mold casting, and direct chill casting followed by plastic forming operations such as extrusion and forging.

We have found that the zirconium content is optimally not higher than 0.6 wt %. Further we have found that the optimal zirconium content depends on the contents of neodymium and yttrium. In a preferred alloy according to the invention, the zirconium content complies with the following equation:

$$1.3/(\mathrm{Nd}\ wt\ \%+\mathrm{Y}\ wt\ \%)\leqq \mathrm{Zr}\ wt\ \%\leqq 0.6\ wt\ \%$$

In another preferred embodiment of the present invention, a magnesium-based alloy contains 2.9–3.2 wt % Nd, 1.9–2.1 wt % Y, 0.3–0.5 wt % Zr, 0.2–0.4 wt % Zn, 0.03–0.12 wt % Ca, 0–0.0003 wt % Be, 0–0.005 wt % Si, 0–0.005 wt % Fe, and 0–0.001 wt % Cu.

The magnesium alloys of the present invention have been tested and compared with comparative samples, including widely used, commercially available magnesium-based alloys WE43, ZE41 and QE22. The alloys were prepared in a 100 liter crucible made of low carbon steel and cast into 8 kg ingots. The mixture of $CO_2$+0.5% $SF_6$ was used as a protective atmosphere. The ingots of all new and comparative alloys were then re-melted and permanent mold cast, obtaining bars 30 mm in diameter, which were used for the preparation of specimens for tensile, compressive, fatigue, corrosion and creep tests. The ring test was used in order to evaluate susceptibility to hot tearing. Another parameter characterizing castability is fluidity, i.e. the ability of the molten metal to continue to flow and fill thin mold sections, also as it cools down. Fluidity properties were analyzed using spiral mold test. Some alloys were re-melted and direct chill cast into billets with 100 mm diameter. After scalping, the billets were annealed at 500° C. for 10 hrs, and extruded at 450° C. to round bars of 30 mm in diameter. Permanent mold cast alloys were subjected to heat treatment to obtain the best combination of mechanical properties. Tensile yield strength (TYS), Ultimate Tensile Strength (UTS), percent elongation (%E), and Compression Yield strength (CYS) were then determined. Corrosion behavior was evaluated by the immersion corrosion test as per ASTM Standard G31-87. Fatigue tests were carried out using high frequency resonance method. For aerospace and automotive applications, the fatigue performance of magnesium alloys in aggressive corrosion environment is of particular importance. It is known that commercial wrought magnesium alloys are prone to corrosion cracking. Therefore, fatigue tests were performed both in ambient air and in spray of aqueous 5% NaCl solution (corrosion fatigue test).

The results show that the new alloys exhibit better fluidity and lower susceptibility to hot cracking than comparative alloys. The melt loss for the new alloys is also lower than for comparative alloys. It is a very important factor because the alloys contain rather expensive elements.

Neither burning nor oxidation was observed on the surface of ingots made of alloys according to this invention. In contrast to this, the preparation of comparative alloys was accompanied by strong oxidation and undesirable losses of alloying elements, particularly yttrium.

The mechanical properties of the alloys of this invention exhibit similar or higher strength than that of commercial alloy WE43 (comparative example 1) and QE22 (comparative example 3). All new alloys are superior in strength with regard to all other comparative alloys, including ZE41 (comparative example 2). The new alloys also surpass commercial alloys in fatigue strength and corrosion resistance. However, the greatest advantage of the new alloys was found during performing tensile tests and tensile creep tests at elevated temperatures. The new alloys exhibit similar or higher TYS than WE43 alloy, and significantly higher than the other comparative alloys. As for creeping behavior, the tests show that MCR of the new alloys at both 200° C. and 250° C. is considerably higher than of comparative alloys. The value MCR is by two to three orders of magnitude lower for the alloys according to this invention than for the commercial alloys ZE41 and QE22.

The superb properties of the alloys according to this invention over wide range of temperatures, comprising the ambient temperature, 200° C., and 250° C., make them suitable for long-term applications up to 250° C., as well as for short-term applications at 300° C.

Further, the alloys of this invention show superior corrosion resistance. The corrosion rate (CR) values of all examined alloys of this invention was lower than CR values of any of the comparative samples, in some cases even by one order of magnitude.

It was found that new alloys can reach optimal mechanical properties after accelerated T6 heat treatment, comprising solution heat treatment at 520–560° C., preferably at 540° C., for 2 to 10, preferably for 4 to 6 hours, followed by cooling in a quenchant, and by subsequent aging at 240–260° C., preferably at 250° C., for 0.5 to 7 hours, preferably for 1 to 5 hours, wherein tensile yield strength, compressive yield strength, and creep resistance increase after said treatment.

The alloys according to the invention were also direct chill cast, extruded and compared with comparative examples, including commercial ZK60 wrought alloy for extrusion and forging. The test results show that the new alloys exhibit TYS and UTS slightly lower than ZK60 alloy, and better than other comparative examples alloys. However, all the new alloys significantly surpass all comparative samples in ductility, impact strength and compressive yield strength (CYS). Fatigue strength and particularly fatigue strength in corrosive environment (spray of 5% NaCl solution in water) is the most important property for wrought alloys to be used for production of road wheels for premium and racing cars. All the samples of alloys according to this invention have corrosion fatigue strength better than the comparative alloys, the value being more than twice higher in the new alloys than in the conventional alloy ZK60.

Based on the above findings, the present invention is also directed to the articles made of magnesium alloys described herein before, said articles having improved strength, and creep resistance at ambient temperatures and at elevated temperatures, as well as a good corrosion resistance, wherein said articles are used as parts of automotive or aerospace construction systems.

The present invention is further directed to the articles which were subjected to accelerated T6 heat treatment, comprising solid solution heat treatment at 520–560° C., preferably at 540° C., for 2 to 10 hours, preferably for 4 to 6 hours, followed by cooling in a quenchant, and by subsequent aging at 240–260° C., preferably at 250° C., for 0.5 to 7 hours, preferably for 1 to 5 hours.

Specifically, the present invention relates to alloys which exhibit tensile yield strength at ambient temperature higher than 180 MPa and tensile yield strength at 250° C. higher than 150 MPa; alloys which exhibit minimum creep rate (MCR) less than $2.6\times10^{-9}$/s at 200° C. under stress of 150 MPa; articles which exhibit minimum creep rate less than $2.1\times10^{-9}$/s at 250° C. under stress of 60 MPa. The invention further relates to the alloys which exhibit the average corrosion rate, as measured by the immersion corrosion test as per ASTM Standard G31-87, less than 0.55 mg/cm$^2$/day. This invention further relates to the articles made of such alloys.

The present invention thus provides alloys that are suitable for applications at temperatures as high as 250° C. to 300° C., as well as articles made of these alloys.

The invention will be further described and illustrated in the following examples.

EXAMPLES

General Procedures

The alloys of the present invention were prepared in 100 l crucible made of low carbon steel. The mixture of $CO_2$+ 0.5% $SF_6$ was used as a protective atmosphere. The raw materials used were as follows:

Magnesium—pure magnesium, grade 9980A, containing at least 99.8% Mg.

Zinc—commercially pure Zn (less than 0.1% impurities).

Neodymium—commercially pure Nd (less than 0.5% impurities).

Zirconium—Zr95 TABLETS, containing at least 95% Zr.

Yttrium—commercially pure Y (less than 1% impurities).

Calcium—Mg-30% Ca—master alloy.

Beryllium—in the form of $Na_2BeF4$.

Zinc was added into the molten magnesium during the melt heating in a temperature interval 740° C. to 770° C. Intensive stirring for 2–5 min was sufficient for dissolving this element in the molten magnesium. Neodymium and zirconium were added typically at 770–780° C. Special preparation of the charge in the form of small pieces and intensive stirring of the melt for 15–20 min have been used to accelerate dissolution of these elements in the molten magnesium and to maximize their recovery rate. After addition of zirconium, the melt was held for 20–40 minutes to allow iron to settle. Yttrium (if required) was added after the iron settling, without intensive stirring, to prevent the formation of Y—Fe intermetallic compounds, which leads to excessive loss of yttrium. A strict temperature control was provided during the alloying in order to insure that the melt temperature will not increase above 785° C., thus preventing an excessive contamination by iron from the crucible walls, and to ensure that the temperature will not decrease below 765° C., thus preventing an excessive loss of zirconium. Calcium and beryllium were added prior to settling.

After obtaining the required compositions, the alloys were held for 30–60 minutes for homogenization and settling of iron and non-metallic inclusions, and then they were cast into the 8 kg ingots. The casting was carried out with gas protection of the molten metal during solidification in the molds by $CO_2$+0.5% $SF_6$ mixture. The ingots of all new and comparative alloys were then re-melted and permanent mold cast into 30 mm diameter bars, which were used for the preparation of specimens for tensile, compressive, fatigue, corrosion and creep tests.

The ring test was used in order to evaluate susceptibility to hot tearing. The tests were carried out using steel die with an inner tapered steel core (disk) having a variable diameter (FIG. 1). The core diameter may vary from 30 mm to 100 mm with the step of 5 mm. The test samples have the shape of flat ring with the outer diameter of 110 mm and the thickness of 5 mm. The ring width is varied from 40 mm to 5 mm with the step of 2.5 mm. The susceptibility to hot tearing was evaluated by the minimum width of the ring that can be cast without hot tear formation. The less this value the less susceptibility to hot tearing.

Figure 2:
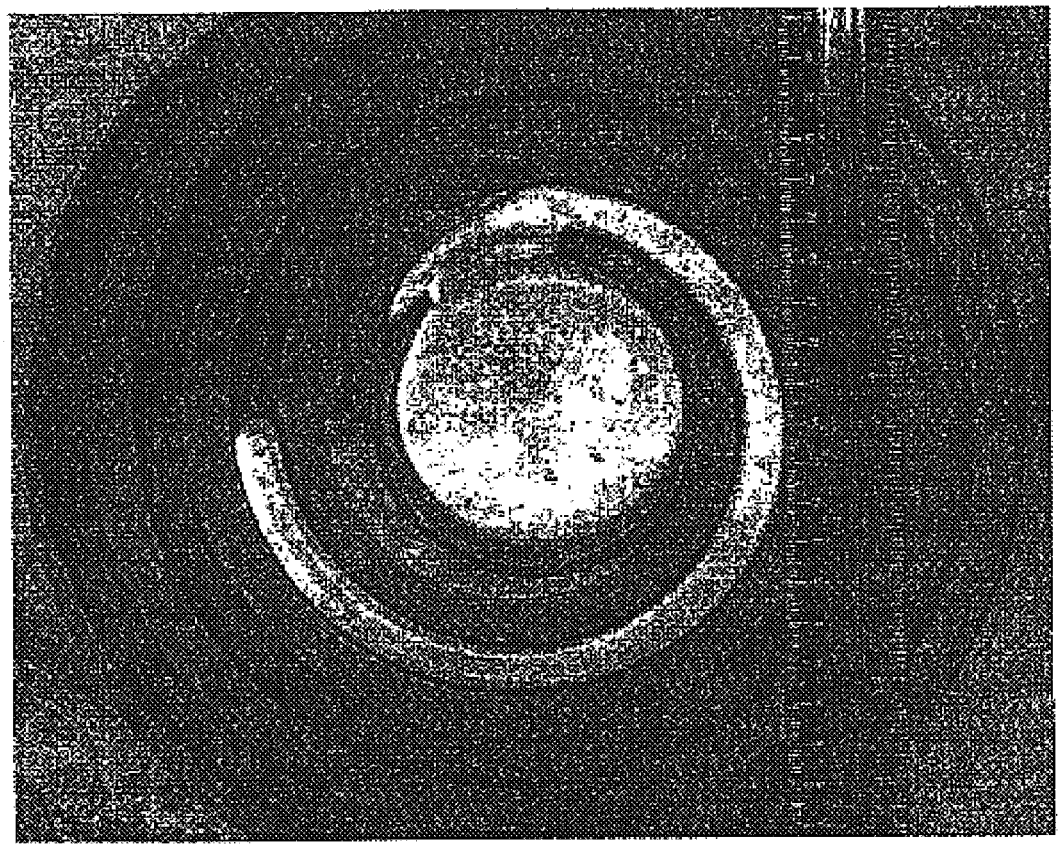
FIG. 2 is a photograph demonstrating the fluidity test.

Fluidity tests are useful for simulation of actual casting situation and can be used for comparative assessment of alloy's castability. Fluidity properties were analyzed using spiral mold test (FIG. 2).

Several alloys in ingot form were re-melted and direct chill cast into billets with 100 mm diameter. After scalping billets were annealed at 500° C. for 10 hrs. The billets were then extruded at 450° C. to round bars with 30 mm diameter. Permanent mold cast alloys were subjected to heat treatment, and optical and mechanical properties were checked. It was found that new alloys can develop optimum mechanical properties after accelerated T6 heat treatment comprising solution heat treatment at 520° C.–560° C., preferably at 540° C. for 2 to 10, preferably 4 to 6 hours, followed by cooling in various quenchants from hot water to still ambient air, with subsequent aging at 240° C. to 260° C. preferably 250° C. for 0.5 to 7 hours, preferably 1 to 5 hours.

Tensile and compression testing at ambient and elevated temperatures were performed using an Instron 4483 machine equipped with an elevated temperature chamber. Tensile yield strength (TYS), Ultimate Tensile Strength (UTS), percent elongation (%E) and Compression Yield strength (CYS) were determined. The SATEC Model M-3 machine was used for creep testing. Creep tests were performed at 200° C. and 250° C. for 200 h under various stresses. Creep resistance was estimated based on the value of minimum creep rate (MCR) and creep strength. Creep strength is usually defined as the stress, which is required to produce a certain amount of creep at a specific time and a given temperature. It is a common practice to report creep strength as the stress, which produces 0.2% creep strain at a given temperature for 100 hours. This parameter is used by design engineers for evaluating the load-carrying ability of a material for limited creep strain in prolonged time periods. Corrosion behavior was evaluated by the immersion corrosion test as per ASTM Standard G31-87. This test consisted of a 72 hrs natural immersion in 5% NaCl solution exposed to ambient laboratory conditions at 35° C. The specimens were shaped as cylindrical rods with the 100 mm length and the 10 mm diameter. The samples were degreased in acetone and weighed prior to the immersion in the test solution. Five replicates of each alloy were tested. At the end of the test the corrosion products were stripped in a chromic acid solution (180 g $CrO_3$ per liter solution) at 80° C. about three minutes and the weight loss was determined. The weight loss was used to determine the average corrosion rate in $mg/cm^2/day$. Fatigue tests were carried out using high frequency resonance method. In this method the specimens are excited to longitudinal resonance vibrations at ultrasonic frequencies around 20 kHz. This leads to sinusoidal cycling loading with maximum load amplitude in the center of the specimen. The specimens with gage diameter of 4 mm were used. The specimens were tested on the base of $10^9$ cycles at the stress ratio R=−1. For aerospace and automotive applications, the fatigue performance of magnesium alloys in aggressive corrosion environment is of particular importance. It is known that commercial wrought magnesium alloys are prone to corrosion cracking. Therefore, fatigue tests were performed both in ambient air and in spray of aqueous 5% NaCl solution (corrosion fatigue test).

Examples 1–10 and Comparative Examples 1–5

Tables 1 to 3 illustrate chemical compositions and properties of alloys according to the invention and alloys of comparative examples. The comparative examples 1, 2, and 3 are the commercial magnesium-based alloys WE43, ZE41 and QE22 respectively. The results of castability tests are listed in Table 2. It is evident that new alloys exhibit better fluidity (longer spiral length) and lower susceptibility to hot cracking (less ring width) than comparative alloys. The melt loss for new alloys is also lower than for comparative alloys. It is a very important factor because both new alloys and comparative alloys contain rather expensive elements like Ag, Y, Nd, Zr and rare earth mish metal. The mechanical properties of permanent mold cast alloys of this invention and comparative alloys are illustrated in Table 3. All new alloys are superior in strength with regard to other comparative alloys. Fatigue strength and corrosion resistance of new alloys also surpass those properties of commercial alloys. Table 3 shows that tensile yield strength (TYS) of new alloys at 250° C. is similar to or higher than that of WE43 alloy and significantly higher than that of other comparative alloys.

A great advantage of the alloys of this invention can be further seen when comparing them with commercial alloys with respect to creep behavior. The table 3 shows that alloys according to this invention can surpass WE43 at both temperatures, with MCR reaching values as low as $1.8\times10^{-9}$ at 250° C./60 MPa. The values of minimum creep rate (MCR) are lower by two or three orders for the new alloys, when being compared with the commercial alloys ZE41 and QE22, both at 200° C. and at 250° C. For example, MCR value of an alloy according to this invention in the Example 8 is $1.8\times10^{-9}$/sec at 250° C., compared to the value $2124\times10^{-9}$ for alloy ZE41.

Examples 11–15 and Comparative Examples 6–8

Five alloys according to the invention, constituting comparative examples 6 to 8, were direct chill cast, extruded and examined as described above. Three comparative alloys were prepared according to the same procedure and used for comparison. The chemical compositions of the said alloys are listed in Table 4. Comparative example 6 is the commercial ZK60 wrought alloy for extrusion and forging. Table 5 demonstrates that new alloys exhibit TYS and UTS better than those of alloys of comparative examples 7 and 8 and slightly worse in these properties to ZK60 alloy. However, new alloys significantly surpass alloys of all comparative examples in ductility, impact strength and compressive yield strength (CYS). Fatigue strength, and particularly fatigue strength in corrosive environment (spray of 5% NaCl solution in water), is the most important property for wrought alloys to be used for production of road wheels for premium and racing cars. As can be seen from Table 5 new alloys of the instant invention possess corrosion fatigue strength, which is more than twice higher than that of conventional alloy ZK60 (comparative example 6), and are also superior in fatigue properties to other comparative alloys.

While this invention has been described in terms of some specific examples, many modifications and variations are possible. It is therefore understood that within the scope of the of the appended claims, the invention may be realized otherwise than as specifically described.

What is claimed is:

1. A magnesium-based alloy containing a) at least 92 wt % magnesium, b) 2.7 to 3.3 wt % neodymium, c) >0 to 2.6 wt % yttrium, d) 0.2 to 0.8 wt % zirconium, e) 0.2 to 0.8 wt % zinc, f) 0.03 to 0.25 wt % calcium, and g) 0.00 to 0.001 wt % beryllium.

2. An alloy according to claim 1, additionally containing up to 0.007 wt % iron, up to 0.002 wt % nickel, up to 0.003 wt % copper, and up to 0.01 wt % silicon.

3. An alloy according to claim 1, further containing incidental impurities.

4. An alloy according to claim 1, containing from 0.2 to 0.5 wt % Zn, and from 0.03 to 0.15 wt % Ca.

5. An alloy according to claim 1, which contains 2.9–3.2 wt % Nd, 1.9–2.1 wt % Y, 0.3–0.5 wt % Zr, 0.2–0.4 wt % Zn, and 0.03–0.12 wt % Ca.

6. An alloy according to claim 1, containing less than 0.005 wt % iron, less than 0.001 wt % nickel, less than 0.0015 wt % copper, less than 0.007 wt % silicon, and less than 0.0005 wt % beryllium.

7. An alloy according to claim 1, which contains 0.00–0.0003 wt % Be, 0.00–0.005 wt % Si, and 0.00–0.001 wt % Cu.

8. An alloy according to claim 1, wherein the ratio of Y content to Nd content is from 0 to 0.8.

9. An alloy according to claim 1, wherein the ratio of Y content to Nd content is from 0.45 to 0.70.

10. An alloy according to claim 1, wherein the Zr content depends on the total Nd+Y content according to the following equation:

$$1.3/(\text{Nd } wt\ \% + \text{Y } wt\ \%) \leqq \text{Zr } wt\ \% \leqq 0.6\ wt\ \%.$$

11. An alloy according to claim 1, having high tensile yield strength (TYS) and compressive yield strength (CYS) both at ambient temperature and at elevated temperatures up to 250° C.

12. An alloy according to claim 1, having high creep resistance both at ambient temperature and at temperatures elevated up to 250° C.

13. An alloy according to claim 1, exhibiting the increase of tensile yield strength, compressive yield strength, and creep resistance in response to accelerated T6 heat treatment comprising solid solution heat treatment at 520–560° C. for 2 to 10 hours followed by cooling in a quenchent and by subsequent aging at 240–260° C. for 0.5 to 7 hours.

14. An alloy according to claim 1, exhibiting the increase of tensile yield strength, compressive yield strength, and creep resistance in response to accelerated T6 heat treatment comprising solid solution heat treatment at 540° C. for 4 to 6 hours followed by cooling in a quenchent and by subsequent aging at 250° C. for 1 to 5 hours.

15. An alloy according to claim 1, which has tensile yield strength at ambient temperature higher than 180 MPa and tensile yield strength at 250° C. higher than 150 MPa.

16. An alloy according to claim 1, which has minimum creep rate less than $2.6\times10^{-9}$/s at 200° C. under stress of 150 MPa.

17. An alloy according to claim 1, which has minimum creep rate less than $2.1\times10^{-9}$/s at 250° C. under stress of 60 MPa.

18. An alloy according to claim 1, which has the average corrosion rate, as measured by the immersion corrosion test as per ASTM Standard G31-87, less than 0.55 mg/cm$^2$/day.

19. An alloy according to claim 1, which is suitable for applications at temperatures up to 250° C.

20. An alloy according to claim 1, which is suitable for applications at temperatures up to 300° C.

21. An article which is a casting of a magnesium alloy of claim 1.

22. An article of claim 21, wherein the casting method as chosen from the group consisting of sand casting, permanent mold casting, and direct chill casting with subsequent extrusion and/or forging.

23. An article produced by casting or forming an alloy of claim 1.

24. An article of claim 23, produced by direct chill casting followed by plastic forming operations such as extrusion and forging.

25. An article according to claim 21, which was subjected to accelerated T6 heat treatment comprising solid solution heat treatment at 520–560° C. for 2 to 10 hours, followed by cooling in a quenchent and by subsequent aging at 240–260° C. for 0.5 to 7 hours.

26. An article according to claim 21, which was subject to accelerated T6 heat treatment comprising solid solution heat treatment at 540° C. for 4 to 6 hours, followed by cooling in a quenchent and by subsequent aging at 250° C. for 1 to 5 hours.

27. An article according to claim 21, which is suitable for applications at temperatures up to 250° C.

28. An article according to claim 21, which is suitable for applications at temperatures up to 300° C.

* * * * *